US012042103B2

(12) United States Patent
Hunt

(10) Patent No.: US 12,042,103 B2
(45) Date of Patent: Jul. 23, 2024

(54) TOILET SEALING DEVICE

(71) Applicant: Ryan Hunt, Saskatoon (CA)

(72) Inventor: Ryan Hunt, Saskatoon (CA)

(73) Assignee: Ryan Hunt, Saskatoon (CA)

( * ) Notice: Subject to any disclaimer, the term of this patent is extended or adjusted under 35 U.S.C. 154(b) by 32 days.

(21) Appl. No.: 18/012,680

(22) PCT Filed: Jun. 29, 2020

(86) PCT No.: PCT/CA2020/050908
§ 371 (c)(1),
(2) Date: Dec. 23, 2022

(87) PCT Pub. No.: WO2022/000069
PCT Pub. Date: Jan. 6, 2022

(65) Prior Publication Data

US 2023/0255416 A1 Aug. 17, 2023

(51) Int. Cl.
*A47K 13/24* (2006.01)

(52) U.S. Cl.
CPC ..... *A47K 13/242* (2013.01)

(58) Field of Classification Search
CPC ..... A47K 13/242; A47K 13/24
USPC ..... 4/253
See application file for complete search history.

(56) References Cited

U.S. PATENT DOCUMENTS

| | | | | |
|---|---|---|---|---|
| 8,776,278 | B1 | 7/2014 | Dorra | |
| 9,339,158 | B2 | 5/2016 | Dorra | |
| 2006/0206998 | A1 | 9/2006 | Corbin | |
| 2008/0178375 | A1 * | 7/2008 | Moore | A47K 13/242 220/361 |
| 2012/0180208 | A1 | 7/2012 | White | |
| 2022/0408988 | A1 * | 12/2022 | Baines | E03D 9/002 |

FOREIGN PATENT DOCUMENTS

| | | |
|---|---|---|
| CN | 201190319 Y | 2/2009 |
| CN | 209932566 U | 1/2020 |
| WO | WO 2011/092877 | 8/2011 |

OTHER PUBLICATIONS

International Search Report and Written Opinion for PCT/CA2020/050908 dated Feb. 26, 2021, 10 pages.

* cited by examiner

*Primary Examiner* — Huyen D Le
(74) *Attorney, Agent, or Firm* — Frost Brown Todd LLP

(57) ABSTRACT

Devices for sealing a toilet are provided. The devices comprise at least one barrier comprising barrier members configured to releasably and sealingly engage with and magnetically attract to each other. The barrier members are configured to be coupled to a toilet lid, a toilet seat and/or a toilet bowl and when the barrier members sealingly engage with each other, the at least one barrier inhibits or reduces movement of material from inside the toilet bowl to outside the toilet bowl.

6 Claims, 9 Drawing Sheets

TOILET SEALING DEVICE

PRIORITY

This application is a U.S. national entry from PCT/CA2020/050908, entitled "Toilet Sealing Device," filed on Jun. 29, 2020, the disclosure of which is incorporated by reference herein.

FIELD OF THE INVENTION

The present invention relates to toilets, and specifically to devices for sealing toilets.

BACKGROUND OF THE INVENTION

It is well known in the art of toilets to employ a lid to partially inhibit or reduce movement of materials from inside a toilet bowl to outside the toilet bowl. Typically, however, toilet lids only minimally prevent material from exiting a toilet bowl as there are gaps disposed between the lid and the bowl that allow passage of potentially hazardous material to the outside. This is generally the case when the material is in the form of a particulate matter or plumes. Material exiting a toilet bowl can cause an unhygienic condition that may result in the transmission of disease and microbials, such as, but not limited to, the COVID-19 virus.

Numerous toilet related devices have been developed in an effort to provide an easy and simple means to inhibit or reduce movement of materials from inside a toilet bowl to outside the toilet bowl.

For example, United States Patent Application Publication No. 2006/0206998 to Corbin describes a system and apparatus which inhibit or reduce movement of contaminated particles out of a toilet bowl enclosure are disclosed. The system and apparatus include at least one barrier coupled to a seat and/or lid of a toilet which is configured to inhibit or reduce particles from moving out of the toilet bowl enclosure. The barrier further may allow air to move into the toilet bowl enclosure.

The system and apparatus contemplated by Corbin, however, has some drawbacks. In certain embodiments described by Corbin, a spring was employed to assist a hinge in increasing the closing force on a lid or seat and improving a seal thereto. It is well known in the art that springs wear over time, especially when use is frequent, such as in the case of lifting and setting down a toilet seat. Overtime, the employment of a spring for increasing the closing force on a lid or seat may fail resulting an ineffective seal thereby allowing for the movement of particulate out of the toilet bowl enclosure.

Corbin also describes an embodiment of a system that includes one or more valves configured to allow air to flow into the toilet bowl enclosure thereby allowing sufficient air flow into the toilet bowl enclosure such that flushing of the toilet is not inhibited despite a barrier(s) being employed forming a substantially air-tight seal in gaps disposed between the toilet lid, toilet seat and the toilet bowl. Corbin, however, does not contemplate that the employed valves prevent passage of air and material from inside the toilet bowl to outside the toilet bowl thereby causing an unhygienic condition if microbials and other hazardous materials are released.

Furthermore, the barriers contemplated by Corbin still allow material from inside the toilet bowl to move onto the toilet seat during flushing operations due to the barriers being provided adjacent to the outer perimeter of the seat.

This may create a very unsanitary condition that a user would require the whole toilet seat to be sterilized after each and every use.

What is needed, therefore, is a toilet sealing device or system that is relatively simple and robust in construction, while providing means for ensuring any seals are facilitated with a closing force that is maintained overtime and means for to allowing passage of air from outside the toilet bowl to inside the toilet bowl and prevent passage of air and/or material from inside the toilet bowl to outside the toilet bowl. Furthermore, it would be advantageous if the device or system provided a sealing means that inhibits or reduces the movement of material from inside the toilet bowl to move onto the top surface of the toilet seat.

SUMMARY OF THE INVENTION

According to a first broad aspect of the invention, there is provided a device configured for sealing a toilet, the toilet comprising a toilet bowl and a toilet lid, the device comprising:

- at least one first barrier comprising at least one first barrier member and at least one second barrier member configured to releasably sealingly engage with and magnetically attract to each other;
- wherein the at least one first barrier member is configured to be coupled to the toilet lid;
- wherein the at least one second barrier member is configured to be coupled to the toilet bowl;
- wherein when the at least one first barrier member and the at least one second barrier member sealingly engage with each other, the at least one first barrier inhibits or reduces movement of material from inside the toilet bowl to outside the toilet bowl.

Preferably, wherein when the toilet further comprises a toilet seat, the device further comprises:

- at least one second barrier comprising at least one third barrier member and at least one fourth barrier member configured to releasably sealingly engage with and magnetically attract to each other;
- wherein the at least one third barrier member is configured to be coupled to the toilet lid;
- wherein the at least one fourth barrier member is configured to be coupled to the toilet seat;
- at least one third barrier comprising at least one fifth barrier member and at least one sixth barrier member configured to releasably sealingly engage with and magnetically attract to each other;
- wherein the at least one fifth barrier member is configured to be coupled to the toilet seat;
- wherein the at least one sixth barrier member is configured to be coupled to the toilet bowl;
- wherein when the at least one third barrier member and the at least one fourth barrier member sealingly engage with each other and the at least one fifth barrier member and the at least one sixth barrier member sealingly engage with each other, the at least one second barrier and the at least one third barrier inhibits or reduces movement of material from inside the toilet bowl to outside the toilet bowl.

According to a second broad aspect of the invention, there is provided a device configured for sealing a toilet, the toilet comprising a toilet bowl, a toilet seat and a toilet lid, the device comprising:

- at least one first barrier comprising at least one first barrier member and at least one second barrier member configured to releasably sealingly engage with and magnetically attract to each other;

at least one second barrier comprising at least one third barrier member and at least one fourth barrier member configured to releasably sealingly engage with and magnetically attract to each other;

wherein the at least one first barrier member is configured to be coupled to the toilet lid;

wherein the at least one second barrier member is configured to be coupled to the toilet seat;

wherein the at least one third barrier member is configured to be coupled to the toilet seat;

wherein the at least one fourth barrier member is configured to be coupled to the toilet bowl;

wherein when the at least one first barrier member and the at least one second barrier member sealingly engage with each other and the at least one third barrier member and the at least one fourth barrier member sealingly engage with each other, the at least one first barrier and the at least one second barrier inhibit or reduce movement of material from inside the toilet bowl to outside the toilet bowl.

BRIEF DESCRIPTION OF THE DRAWINGS

In the accompanying drawings, which illustrate exemplary embodiments of the present invention.

Figure 1:
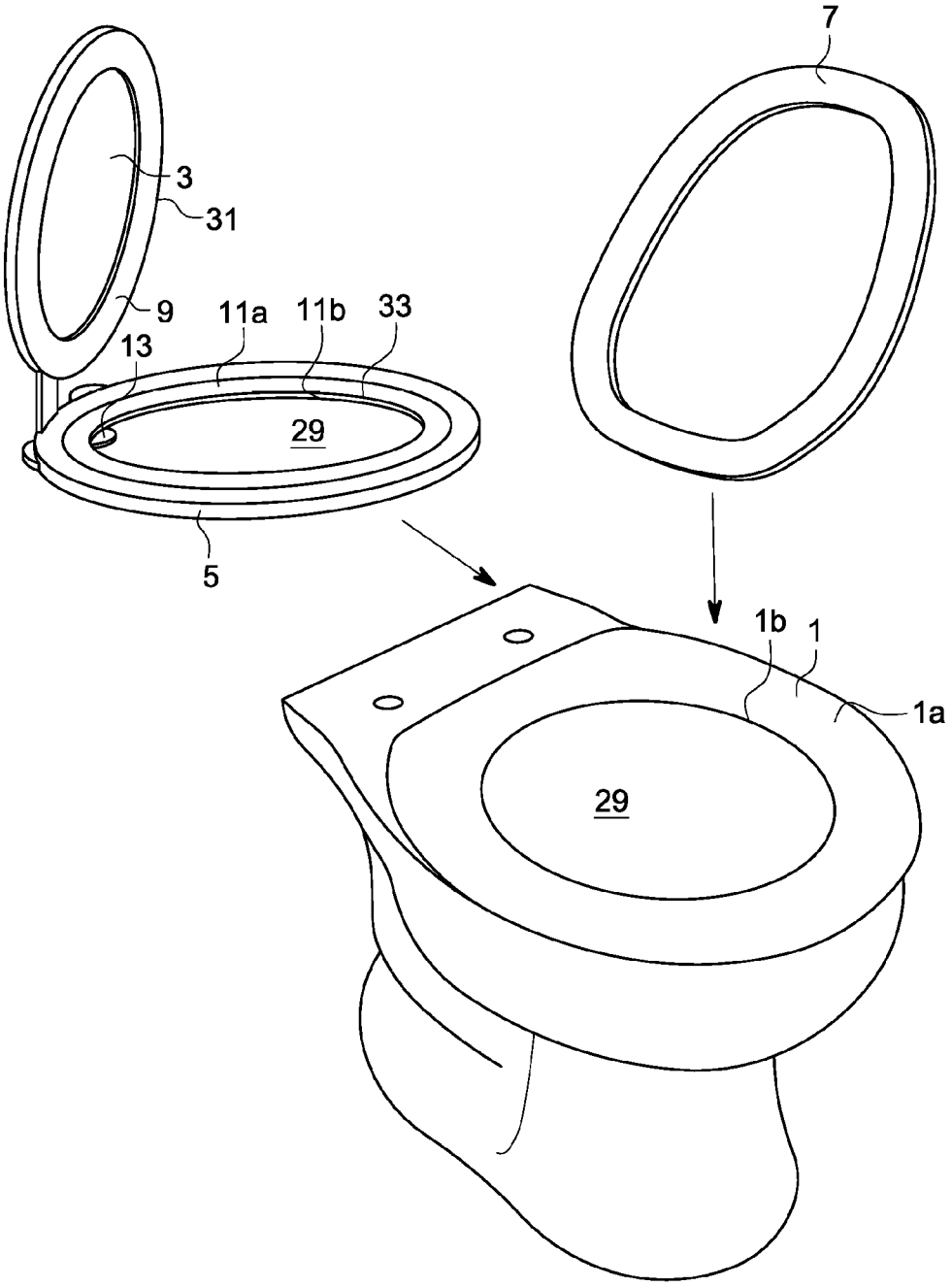
FIG. 1 is an exploded perspective view of a first embodiment of the present invention implemented with a toilet.

Exemplary embodiments of the present invention will now be described with reference to the accompanying drawings.

DETAILED DESCRIPTION OF EXEMPLARY EMBODIMENTS

Throughout the following description specific details are set forth in order to provide a more thorough understanding to persons skilled in the art. However, well known elements may not have been shown or described in detail to avoid unnecessarily obscuring the disclosure. The following description is not intended to be exhaustive or to limit the invention to the precise form of any exemplary embodiment. Accordingly, the description and drawings are to be regarded and interpreted in an illustrative, rather than a restrictive, sense.

The present invention is directed to devices for sealing a toilet. The devices comprise at least one barrier comprising barrier members configured to releasably and sealingly engage with and magnetically attract to each other. The barrier members are configured to be coupled to a toilet lid, a toilet seat and/or toilet bowl and when the barrier members sealingly engage with each other, the at least one barrier inhibits or reduces movement of material from inside the toilet bowl to outside the toilet bowl.

Turning to FIGS. 1 to 4, a first embodiment of the present invention is illustrated. A toilet sealing device 100 is shown that is mounted or configured to be mounted onto a typical toilet 101 having toilet bowl 1, a toilet seat 5 and a toilet lid 3.

The device 100 comprises a first barrier member 9 coupled to or embedded into the toilet lid 3 and a second barrier member 11*a* coupled to or embedded into the toilet seat 5. The first barrier member 9 and second barrier member 11*a* may respectively be coupled to the toilet lid 3 and toilet seat 5 by a variety of means such as, but not limited to, glues and adhesives. The first barrier member 9 and the second barrier member 11*a* are configured to releasably and sealingly engage with and magnetically attract to each other. As the toilet lid 3 is positioned rotatably towards the toilet seat 5, the first barrier member 9 and the second barrier member 11*a* sealingly engage with each other.

Figure 2:
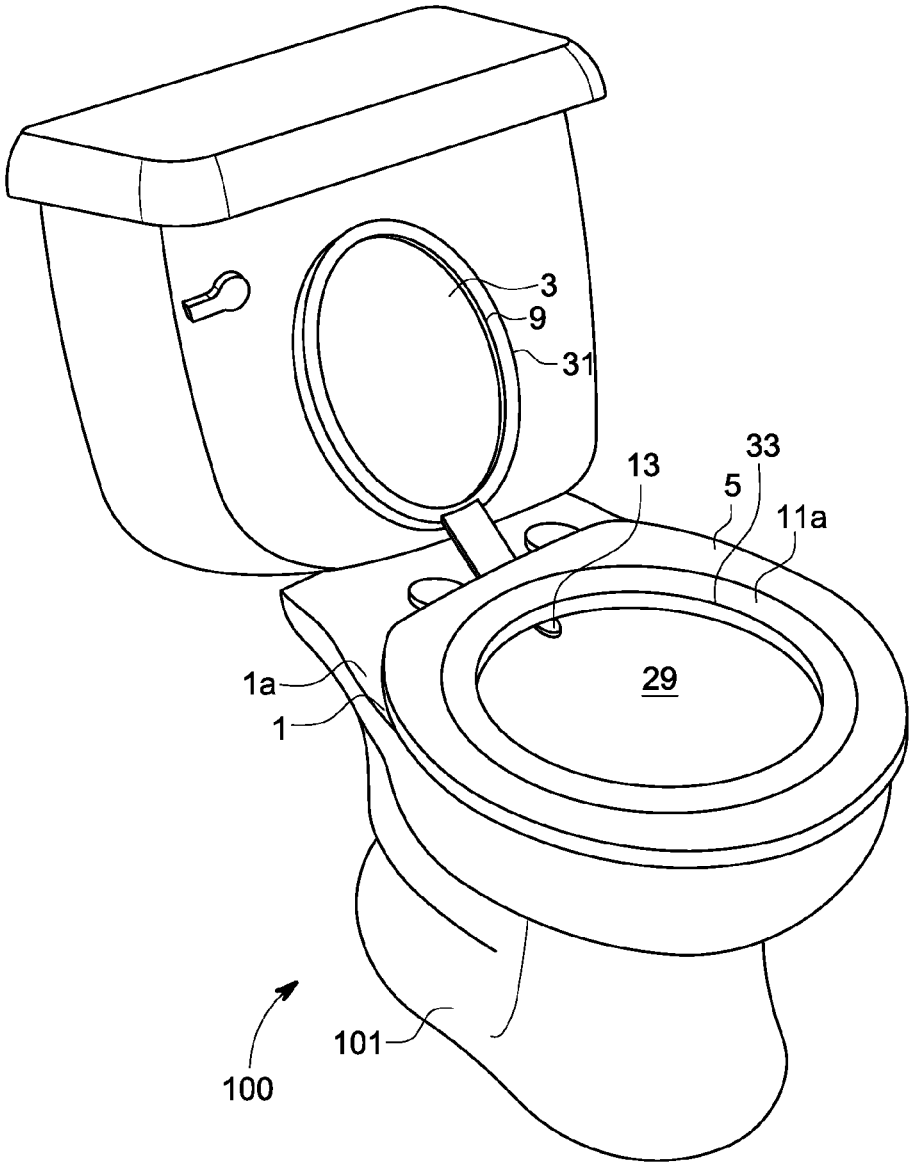
FIG. 2 is a perspective view of the first embodiment of the present invention implemented with a toilet.
Figure 3:
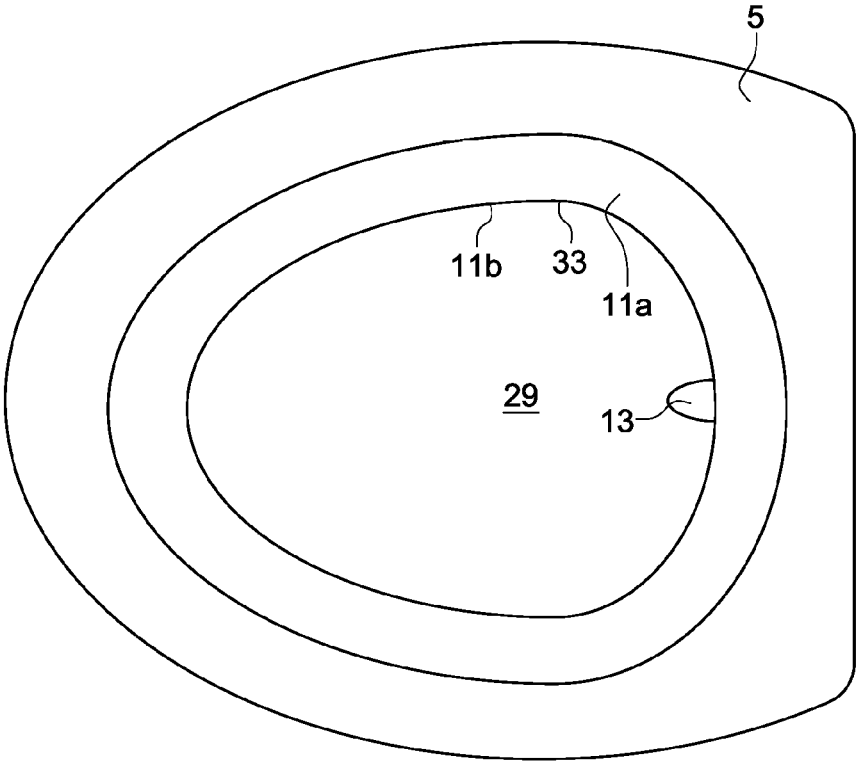
FIG. 3 is a top view of the first embodiment of the present invention implemented with a toilet.

As shown in FIGS. 1 and 2, the first barrier member 9 is coupled to the outer peripheral extent 31 of the lid 3, while the second barrier member 11*a* is coupled to an interior peripheral extent 33 of the seat 5 defining the aperture 29 in the seat. As a result of this, when the first barrier member 9 and the second barrier member 11*a* sealingly engage with each other, the movement of material from inside the toilet bowl 1 onto the top surface of the toilet seat 5 is inhibited or reduced. Preferably, the lid 3 and the first barrier member 9 fit inside seat 5 while the first barrier member 9 and the second barrier member 11*a* sealingly engage with each other, thereby plugging the aperture 29 and inhibiting or reducing the movement of material from inside the toilet bowl 1 onto the top surface of the toilet seat 5. In such embodiments, it is preferable that the top surface of the lid 3 and the first barrier member 9 are flush with seat 5 top surface while plugging the aperture 29.

The device 100 further comprises a third barrier member 11*b* coupled to or embedded into the toilet seat 5 and a fourth barrier member 7 coupled to or embedded into the toilet bowl 1 onto a toilet bowl top surface 1*a* or toilet bowl inner surface 1*b*. The third barrier member 11*b* and fourth barrier member 7 may respectively be coupled to the toilet seat 5 and toilet bowl 1 by a variety of means such as, but not limited to, glues and adhesives. The third barrier member 11*b* and the fourth barrier member 7 are configured to releasably and sealingly engage with and magnetically attract to each other. As the toilet seat 5 is rotatably positioned towards the toilet bowl 1, the third barrier member 11*b* and the fourth barrier member 7 sealingly engage with each other.

When the first barrier member 9 and the second barrier member sealingly 11*a* engage with each other and the third barrier member 11*b* and the fourth barrier member 7 sealingly engage with each other, barriers are formed that inhibit or reduce movement of material from inside the toilet bowl 1 to outside the toilet bowl 1. This may be achieved by the formed barriers that at least partially fill a first gap disposed between the toilet lid 3 and the toilet seat 5 and a second gap disposed between the toilet seat 5 and the toilet bowl 1.

Preferably, when the first barrier member 9 and the second barrier member sealingly 11*a* engage with each other and the third barrier member 11*b* and the fourth barrier member 7 sealingly engage with each other, air-tight seals are formed that assist in the inhibition or reduction of movement of material from inside the toilet bowl 1 to outside the toilet bowl 1. This can be achieved as the barrier members may comprise flexible materials such as, but not limited to neoprene, silicon, rubberized and/or plastic materials.

As described above, the barrier members may be configured to magnetically attract to each other. This can be achieved as the barrier members may comprise ferromagnetic materials. Preferably, the barrier members are configured to magnetically attract to each other with a magnitude of magnetic attractive force allowing them to be remain sealingly engaged with each other during toilet bowl flushing operations.

It is believed that for certain types of toilets, significantly inhibiting the passage of air into the toilet bowl may be detrimental to proper operation of the toilet during flushing. To assist with proper flushing operations, the device 100 may further comprise a valve configured to allow passage of air from outside the toilet bowl to inside the toilet bowl and prevent passage of air and/or material from inside the toilet bowl to outside the toilet bowl. Numerous one-way valves that may be employed for the present are known to those skilled in the art.

Figure 4:
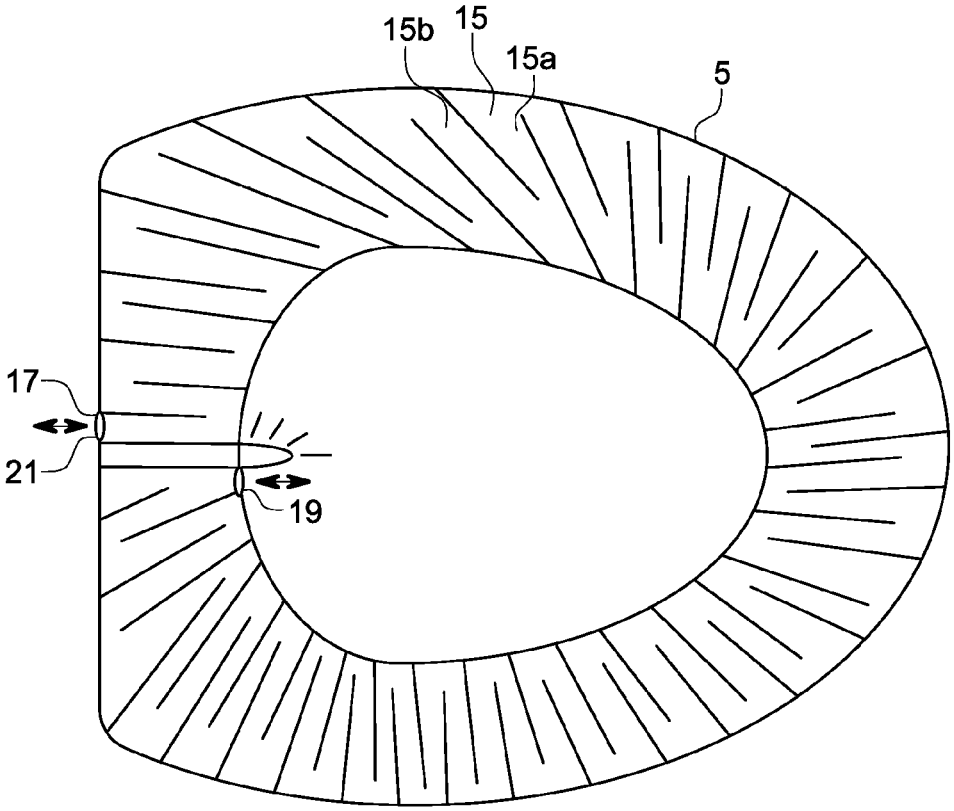
FIG. 4 is a top cross-sectional view of the first embodiment of the present invention implemented with a toilet seat.

In some embodiments, the device 100 comprises an elongated passage 15 having a first end 17 and a second end 19 such that the first end 17 is adjacent to the outside of the toilet bowl 1 and the second end 19 is adjacent to the inside of the toilet bowl 1. Preferably for such embodiments, the passage 15 comprises a first portion 15*a* and a second portion 15*b* such that the first portion 15*a* and the second portion 15*b* are positioned essentially parallel to each other thereby allowing passage of air from outside the passage to inside the toilet bowl 1 while inhibiting or reducing passage of material from inside the passage 15 to outside the passage 15. FIG. 4 illustrates such an embodiment such that the passage 15 is provided inside a toilet seat 5. As material moves from inside the toilet bowl 1 into the passage, a portion of the material gets trapped in the passage due to it impacting a turn connecting the first portion to the second portion. A greater number of passage 15 portions and turns increases the inhibition or reduction of passage of material from inside the passage 15 to outside the passage 15. A flap 21 may be couple to the first end 17 to assist in the inhibition or reduction of passage of material from inside the passage 15 to outside the passage 15. The flap 21 is configured to open and allow air to enter into the passage 15 but remain closed and inhibit or reduce materials from existing the passage 15.

In operation, a user, after use of the toilet 101, closes the toilet lid 3 such that the first barrier member 9 and second barrier member 11*a* sealingly engage with each other. The seat 5 may already be in down position during use, and if not, the user puts down the seat, before closing the lid 3, such that the third barrier member 11*b* and fourth barrier member 7 sealingly engage with each other. As the user flushes the toilet, the barrier members remained sealingly engaged due to the magnetic attractive closing force resulting from magnetic materials in the barrier members. To assist with flushing operations, a valve allows passage of air from outside the toilet bowl 1 to inside the toilet bowl 1 while preventing passage of air and/or material from inside the toilet bowl 1 to outside the toilet bowl 1.

In a second embodiment of the present invention, a toilet sealing device, akin to that described with respect to the first embodiment of the present invention, however, is mounted or configured to be mounted onto a toilet having toilet bowl and a toilet lid (i.e., no toilet seat).

The device comprises a first barrier member coupled to or embedded into the toilet lid and a second barrier member coupled to or embedded into the toilet bowl. The first barrier member and second barrier member may respectively be coupled to the toilet lid and toilet bowl by a variety of means such as, but not limited to, glues and adhesives. The first barrier member and the second barrier member are configured to releasably and sealingly engage with and magnetically attract to each other. As the toilet lid is positioned rotatably towards the toilet bowl, the first barrier member and the second barrier member sealingly engage with each other.

Similarly to the first embodiment, in some embodiments, the first barrier member may be coupled to the outer peripheral extent of the lid, while the second barrier member may be coupled to an interior peripheral extent of the bowl defining an opening into the bowl. As a result of this, when the first barrier member and the second barrier member sealingly engage with each other, the movement of material from inside the toilet bowl onto the top surface of the toilet bowl (see 1*a*) is inhibited or reduced. Preferably, the lid and the first barrier member fit inside the bowl while the first barrier member and the second barrier member sealingly engage with each other, thereby plugging the toilet bowl opening and inhibiting or reducing the movement of material from inside the toilet bowl onto the top surface of the bowl. In such embodiments, it is preferable that the top surface of the lid and the first barrier member are flush with bowl top surface while plugging the opening.

When the first barrier member and the second barrier member sealingly engage with each other, a barrier is formed that inhibits or reduces movement of material from inside the toilet bowl to outside the toilet bowl. This may be achieved by the formed barrier that at least partially fill a gap disposed between the toilet lid and the toilet bowl.

Preferably, when the first barrier member and the second barrier member sealingly engage with each other, an air-tight seal is formed that assists in the inhibition or reduction of movement of material from inside the toilet bowl to outside the toilet bowl. This can be achieved as the barrier members may comprise flexible materials such as, but not limited to neoprene, silicon, rubberized and/or plastic materials.

As described above, the barrier members may be configured to magnetically attract to each other. This can be achieved as the barrier members may comprise ferromagnetic materials. Preferably, the barrier members are configured to magnetically attract to each other with a magnitude of magnetic attractive force allowing them to be remain sealingly engaged with each other during toilet bowl flushing operations.

It is believed that for certain types of toilets, significantly inhibiting the passage of air into the toilet bowl may be detrimental to proper operation of the toilet during flushing. To assist with proper flushing operations, the device may further comprise a valve configured to allow passage of air from outside the toilet bowl to inside the toilet bowl and prevent passage of air and/or material from inside the toilet bowl to outside the toilet bowl. Numerous one-way valves that may be employed for the present are known to those skilled in the art.

In some embodiments, the device comprises an elongated passage having a first end and a second end such that the first end is adjacent to the outside of the toilet bowl and the second end is adjacent to the inside of the toilet bowl. Preferably for such embodiments, the passage comprises a first portion and a second portion such that the first portion and the second portion are positioned essentially parallel to each other thereby allowing passage of air from outside the passage to inside the toilet bowl while inhibiting or reducing passage of material from inside the passage to outside the passage. As material moves from inside the toilet bowl into the passage, a portion of the material gets trapped in the passage due to it impacting a turn connecting the first portion to the second portion. A greater number of passage portions and turns increases the inhibition or reduction of passage of material from inside the passage to outside the passage. A flap may be couple to the first end to assist in the inhibition or reduction of passage of material from inside the passage to outside the passage. The flap is configured to open and allow air to enter into the passage but remain closed and inhibit or reduce materials from existing the passage.

Turning to FIGS. 5 to 9, a third embodiment of the present invention is illustrated. A toilet sealing device 3100 is shown that is mounted or configured to be mounted onto a typical toilet 3101 having toilet bowl 31, a toilet seat 35 and a toilet lid 33. The toilet seat 35, however, is U-shaped having a space 323. The space 323 extends between the outer peripheral extent 335 and the inner peripheral extent 333 of the seat 35 forming spaced-apart ends of the seat 35. The lid 33 comprises a nub member 325 that is configured to fit inside the space 323.

The device 3100 comprises a first barrier member 39 coupled to or embedded into the toilet lid 33 and a second barrier member 37 coupled to or embedded into the toilet bowl 31. The first barrier member 39 and second barrier member 37 may respectively be coupled to the toilet lid 33 at the bottom surface of the nub member 325 and the toilet bowl 31 adjacent to the space 323 by a variety of means such as, but not limited to, glues and adhesives. The first barrier member 39 and the second barrier member 37 are configured to releasably and sealingly engage with and magnetically attract to each other. As the toilet lid 33 is positioned rotatably towards the toilet bowl 31, the first barrier member 39 and the second barrier member 37*a* sealingly engage with each other.

The device 3100 further comprises a third barrier member 39*a* coupled to or embedded into the toilet lid 33 and a fourth barrier member 311*a* coupled to or embedded into the toilet seat 35. The third barrier member 39*a* and fourth barrier member 311*a* may respectively be coupled to the toilet lid 33, including at the side surfaces of the nub member 325, and the toilet seat 35 by a variety of means such as, but not limited to, glues and adhesives. The third barrier member 39*a* and the fourth barrier member 311*a* are configured to releasably and sealingly engage with and magnetically attract to each other. As the toilet lid 33 is rotatably positioned towards the toilet seat 35, the third barrier member 39*a* and the fourth barrier member 311*a* sealingly engage with each other.

Figure 5:
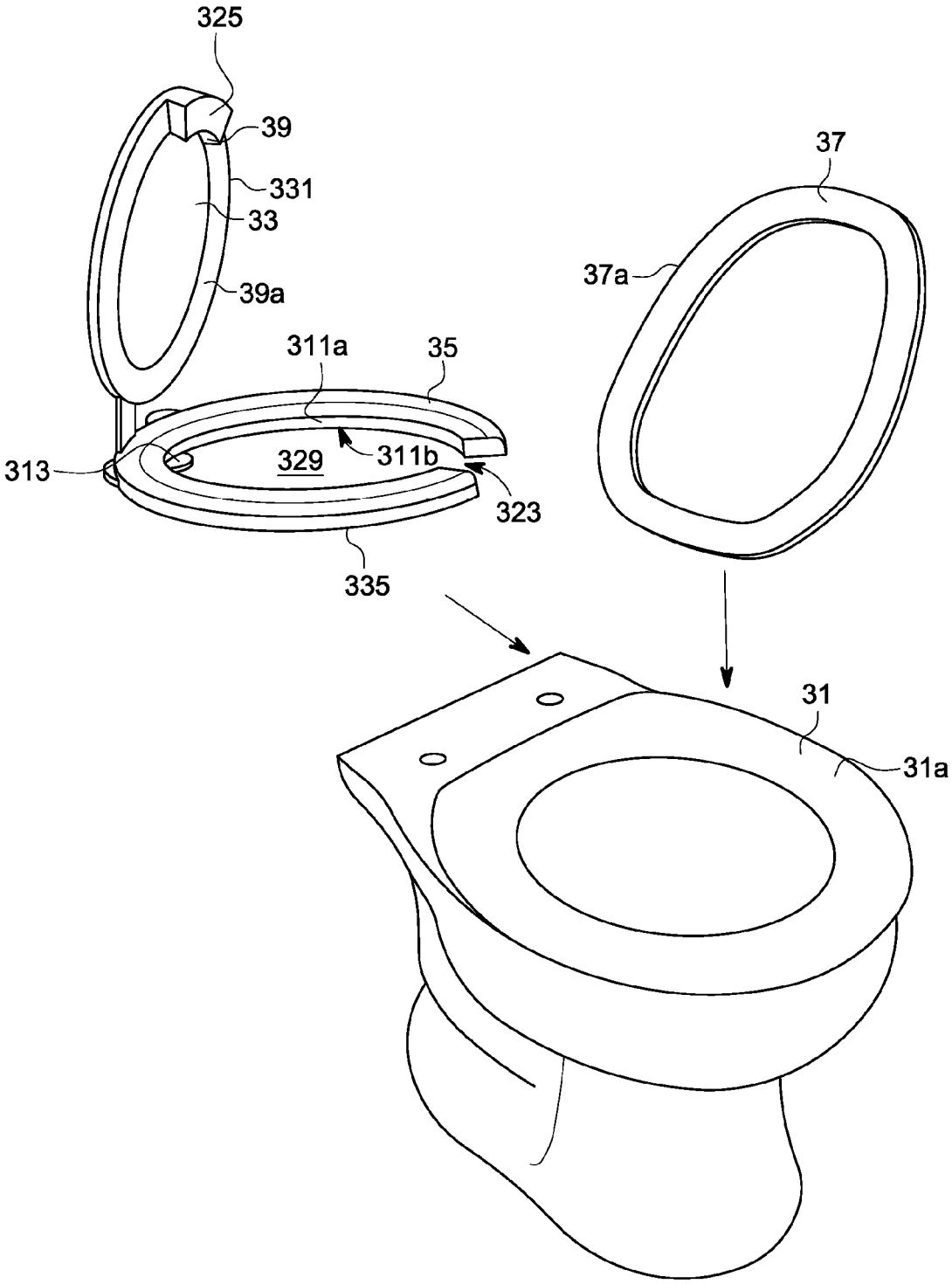
FIG. 5 is an exploded perspective view of a third embodiment of the present invention implemented with a toilet.
Figure 6:
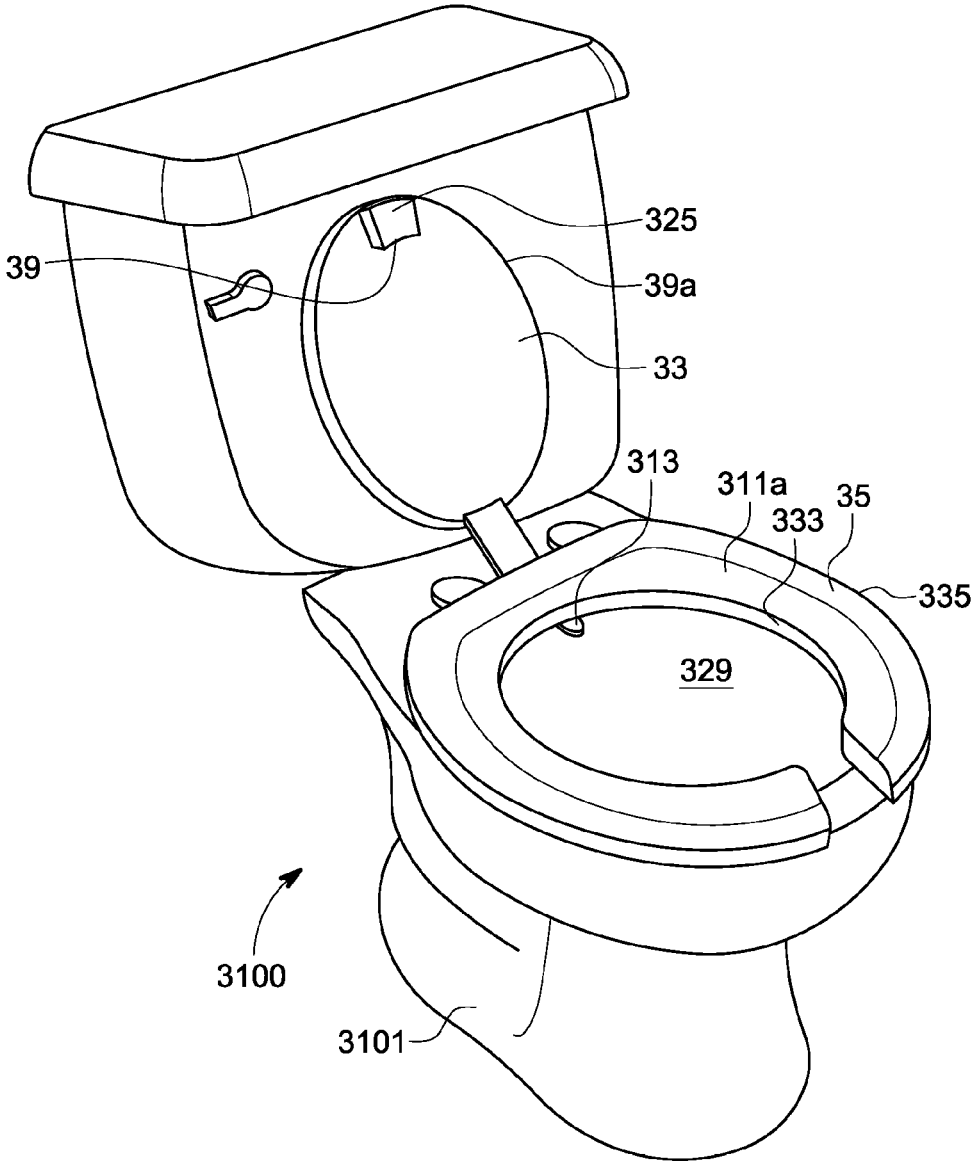
FIG. 6 is a perspective view of the third embodiment of the present invention implemented with a toilet.
Figure 7:
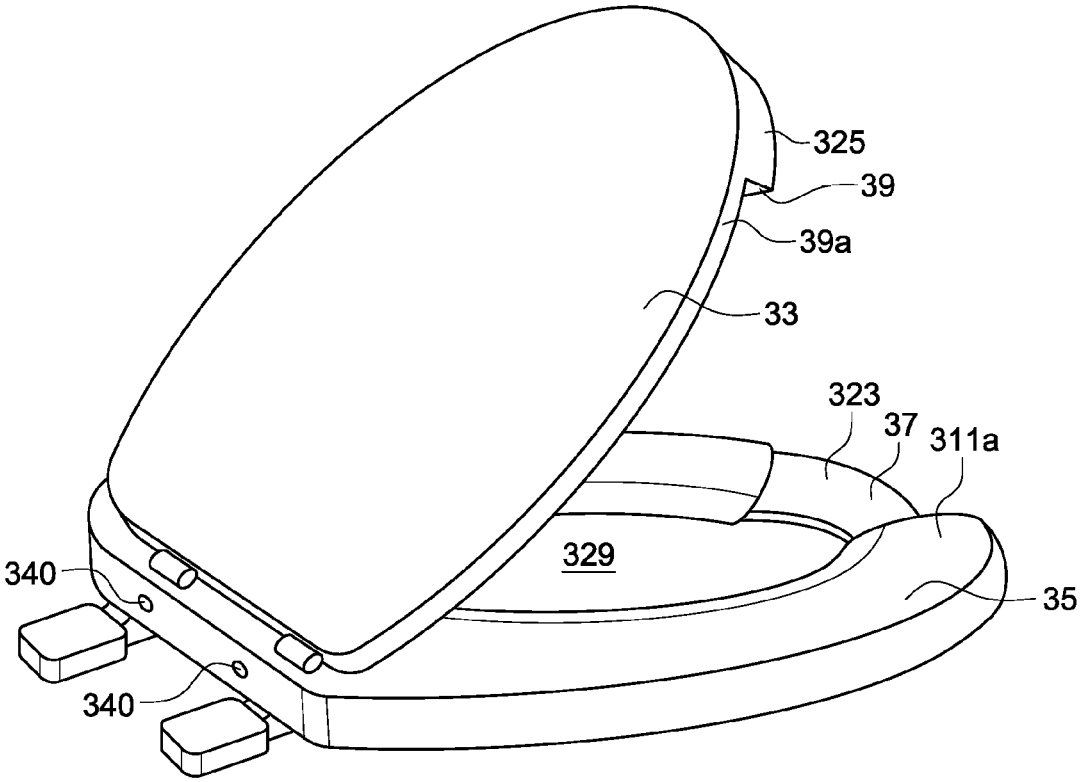
FIG. 7 is a partial perspective view of the third embodiment of the present invention implemented with a toilet.
Figure 8:
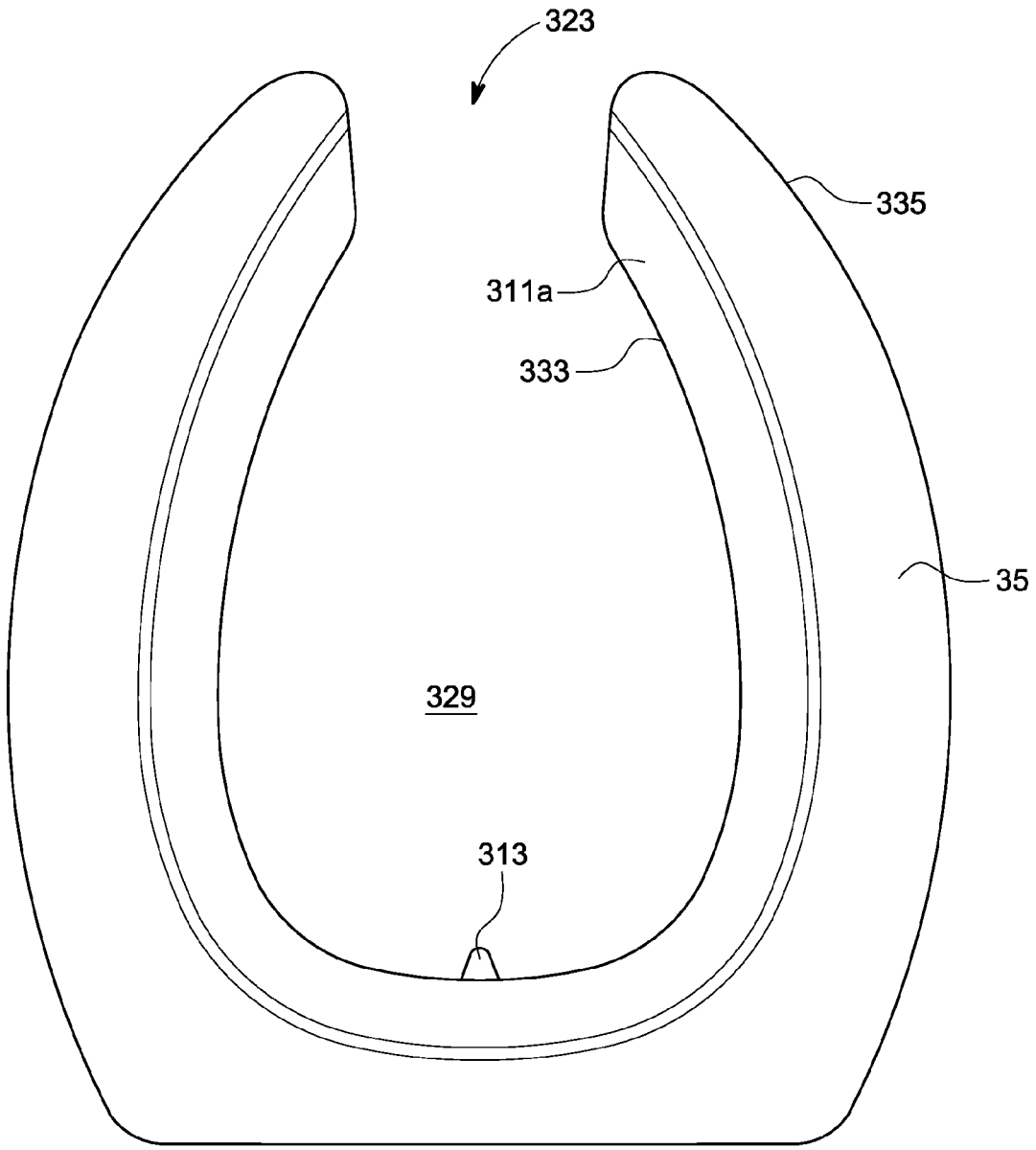
FIG. 8 is a top view of the third embodiment of the present invention implemented with a toilet.

As shown in FIGS. 5 and 6, the third barrier member 39*a* is coupled to the outer peripheral extent 331 of the lid 33 and the sides of the nub 325, while the fourth barrier member 311*a* is coupled to the inner peripheral extent 333 of the seat 35 defining the aperture 329 in the seat. As a result of this, when the third barrier member 39*a* and the fourth barrier member 311*a* sealingly engage with each other, the movement of material from inside the toilet bowl 31 onto the top surface of the toilet seat 35 is inhibited or reduced. Preferably, the lid 33 and the third barrier member 39*a* fit inside the seat 35 while the third barrier member 39*a* and the fourth barrier member 311*a* sealingly engage with each other, thereby plugging the aperture 329 and inhibiting or reducing the movement of material from inside the toilet bowl 31 onto the top surface of the toilet seat 35. In such embodiments, it is preferable that the top surface of the lid 33 and the third barrier member 39*a* are flush with the seat 35 top surface while plugging the aperture 329.

The device 3100 further comprises a fifth barrier member 311*b* coupled to or embedded into the toilet seat 35 and a sixth barrier member 37*a* coupled to or embedded into the toilet bowl 31 onto a toilet bowl top surface 31*a*. The fifth barrier member 311*b* and sixth barrier member 37*a* may respectively be coupled to the toilet seat 35 and toilet bowl 31 by a variety of means such as, but not limited to, glues and adhesives. The fifth barrier member 311*b* and the sixth barrier member 37*a* are configured to releasably and sealingly engage with and magnetically attract to each other. As the toilet seat 35 is rotatably positioned towards the toilet bowl 31, the fifth barrier member 311*b* and the sixth barrier member 37 sealingly engage with each other.

When the first barrier member 39 and the second barrier member sealingly 37 engage with each other, the third barrier member 39*a* and the fourth barrier member 311*a* sealingly engage with each other and the fifth barrier member 311*b* and the sixth barrier member 37 sealingly engage with each other, barriers are formed that inhibit or reduce movement of material from inside the toilet bowl 31 to outside the toilet bowl 31. This may be achieved by the formed barriers that at least partially fill a first gap disposed between the toilet lid 33 (at the nub member 325) and the toilet bowl 31 adjacent to the space 323, a second gap disposed between the toilet lid 33 and the toilet seat 35 and a third gap disposed between the toilet seat 35 and the toilet bowl 31.

Preferably, when the first barrier member 39 and the second barrier member sealingly 37 engage with each other, the third barrier member 39*a* and the fourth barrier member 311*a* sealingly engage with each other and the fifth barrier member 311*b* and the sixth barrier member 37 sealingly engage with each other, air-tight seals are formed that assist in the inhibition or reduction of movement of material from inside the toilet bowl 31 to outside the toilet bowl 31. This can be achieved as the barrier members may comprise flexible materials such as, but not limited to neoprene, silicon, rubberized and/or plastic materials.

As described above, the barrier members may be configured to magnetically attract to each other. This can be achieved as the barrier members may comprise ferromagnetic materials. Preferably, the barrier members are configured to magnetically attract to each other with a magnitude of magnetic attractive force allowing them to be remain sealingly engaged with each other during toilet bowl flushing operations.

It is believed that for certain types of toilets, significantly inhibiting the passage of air into the toilet bowl may be detrimental to proper operation of the toilet during flushing. To assist with proper flushing operations, the device 3100 may further comprise a valve configured to allow passage of air from outside the toilet bowl to inside the toilet bowl and prevent passage of air and/or material from inside the toilet bowl to outside the toilet bowl. Numerous one-way valves that may be employed for the present are known to those skilled in the art.

Figure 9:
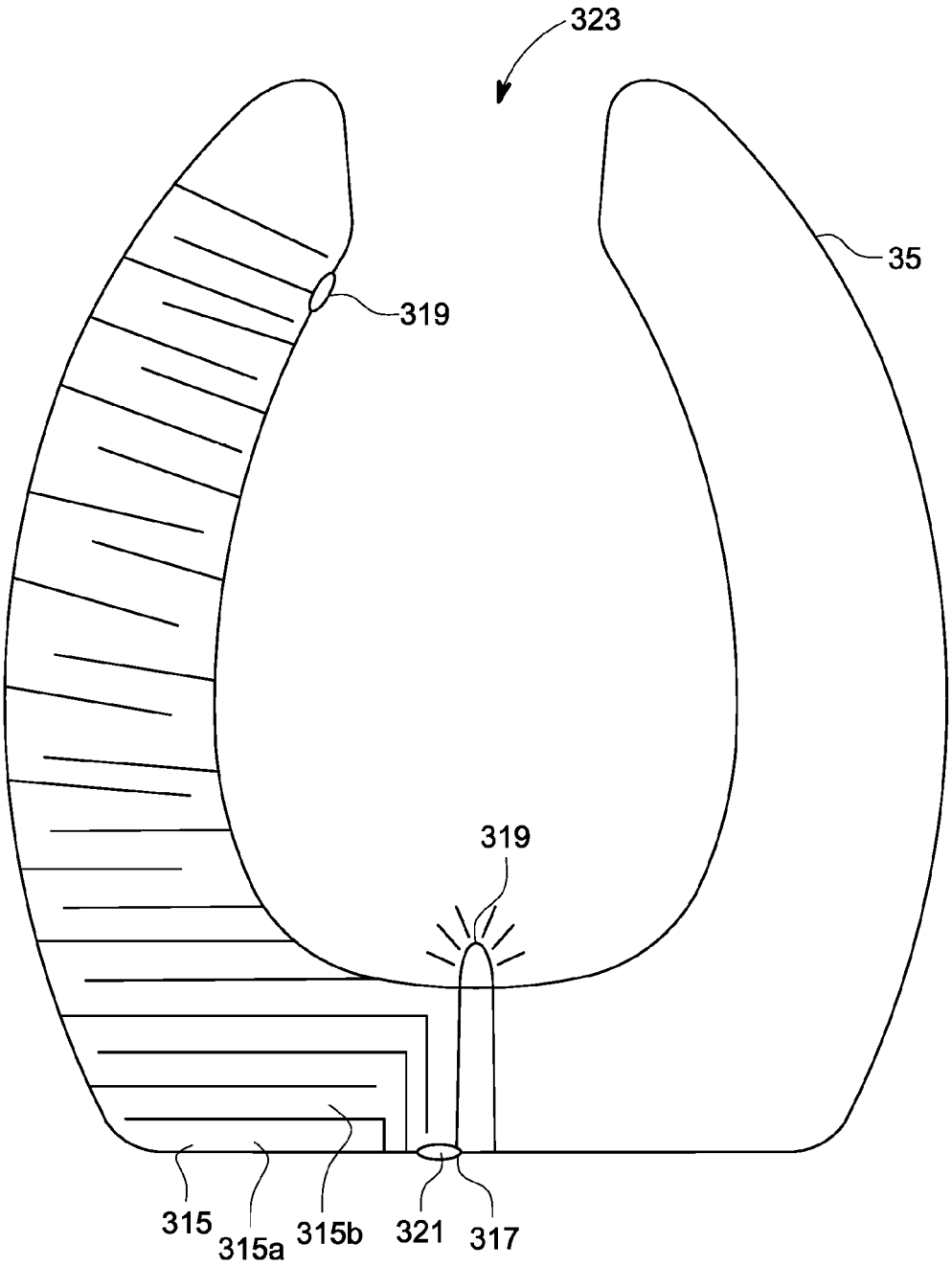
FIG. 9 is a is a top cross-sectional view of the third embodiment of the present invention implemented with a toilet seat.

In some embodiments, the device 3100 comprises an elongated passage 315 having a first end 317 and a second end 319 such that the first end 317 is adjacent to the outside of the toilet bowl 31 and the second end 319 is adjacent to the inside of the toilet bowl 31. Preferably for such embodiments, the passage 315 comprises a first portion 315*a* and a second portion 315*b* such that the first portion 315*a* and the second portion 315*b* are positioned essentially parallel to each other thereby allowing passage of air from outside the passage to inside the toilet bowl 31 while inhibiting or reducing passage of material from inside the passage 315 to outside the passage 315. FIG. 9 illustrates such an embodiment such that the passage 315 is provided inside a toilet seat 35. As material moves from inside the toilet bowl 31 into the passage, a portion of the material gets trapped in the passage due to it impacting a turn connecting the first portion to the second portion. A greater number of passage 315 portions and turns increases the inhibition or reduction of passage of material from inside the passage 315 to outside the passage 315. A flap 321 may be couple to the first end 317 to assist in the inhibition or reduction of passage of material from inside the passage 315 to outside the passage 315. The flap 321 is configured to open and allow air to enter into the passage 315 but remain closed and inhibit or reduce materials from existing the passage 315.

In some exemplary embodiments of the present invention, the device may comprise a sprayer assembly. The sprayer assembly 13, 313 is configured to spay a liquid, such as disinfectant, into the toilet bowl. The sprayer assembly 13, 313 may comprise holes 340 at the back of the seat for the air intake and the spray dispenser intake. Numerous sprayer assemblies would be known to those skilled in the art that may be employed for the present invention. A user my employ the sprayer assembly before lifting a toilet lid to ensure the inside of a toilet bowl is sanitary. In some embodiments, the sprayer assembly nozzle may rotate allowing it to spay a liquid thoroughly, into the toilet bowl.

In some exemplary embodiments of the present invention, the device may comprise a toilet lid where a least a portion of the lid is transparent allowing a user to inspect inside a toilet bowl when the lid is in the closed position and the toilet is sealed.

In some embodiments of the present invention, the barrier members are rubberized such that they damper the impact and noise of impact when closing a toilet component such as the lid or the seat.

Unless the context clearly requires otherwise, throughout the description and the claims:

"comprise", "comprising", and the like are to be construed in an inclusive sense, as opposed to an exclusive or exhaustive sense; that is to say, in the sense of "including, but not limited to".

"connected", "coupled", or any variant thereof, means any connection or coupling, either direct or indirect, between two or more elements; the coupling or connection between the elements can be physical, logical, or a combination thereof.

"herein", "above", "below", and words of similar import, when used to describe this specification shall refer to this specification as a whole and not to any particular portions of this specification.

"or", in reference to a list of two or more items, covers all of the following interpretations of the word: any of the items in the list, all of the items in the list, and any combination of the items in the list.

the singular forms "a", "an" and "the" also include the meaning of any appropriate plural forms.

Words that indicate directions such as "vertical", "transverse", "horizontal", "upward", "downward", "forward", "backward", "inward", "outward", "vertical", "transverse", "left", "right", "front", "back", "top", "bottom", "below", "above", "under", and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g. a circuit, module, assembly, device, etc.) is referred to herein, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of methods and apparatus have been described herein for purposes of illustration. These are only examples. The invention provided herein can be applied to contexts other than the exemplary contexts described above. Many alterations, modifications, additions, omissions and permutations are possible within the practice of this invention. This invention includes variations on described embodiments that would be apparent to the skilled person, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

The foregoing is considered as illustrative only of the principles of the invention. The scope of the claims should not be limited by the exemplary embodiments set forth in the foregoing but should be given the broadest interpretation consistent with the specification as a whole.

What is claimed:

1. A device configured for sealing a toilet, the toilet comprising a toilet bowl and a toilet lid, the device comprising:

at least one first barrier comprising at least one first barrier member and at least one second barrier member configured to releasably sealingly engage with and magnetically attract to each other;

wherein the at least one first barrier member is configured to be coupled to the toilet lid;

wherein the at least one second barrier member is configured to be coupled to the toilet bowl;

wherein when the at least one first barrier member and the at least one second barrier member sealingly engage with each other, the at least one first barrier inhibits or reduces movement of material from inside the toilet bowl to outside the toilet bowl.

2. The device of claim 1, wherein the toilet further comprises a toilet seat, the device further comprising:

at least one second barrier comprising at least one third barrier member and at least one fourth barrier member configured to releasably sealingly engage with and magnetically attract to each other;

wherein the at least one third barrier member is configured to be coupled to the toilet lid;

wherein the at least one fourth barrier member is configured to be coupled to the toilet seat.

3. The device of claim 2 further comprising:

at least one third barrier comprising at least one fifth barrier member and at least one sixth barrier member configured to releasably sealingly engage with and magnetically attract to each other;

wherein the at least one fifth barrier member is configured to be coupled to the toilet seat;

wherein the at least one sixth barrier member is configured to be coupled to the toilet bowl;

wherein when the at least one third barrier member and the at least one fourth barrier member sealingly engage with each other and the at least one fifth barrier member and the at least one sixth barrier member sealingly engage with each other, the at least one second barrier and the at least one third barrier inhibits or reduces movement of material from inside the toilet bowl to outside the toilet bowl.

4. The device of claim 3, wherein the third barrier member is coupled to a lid outer peripheral extent of the lid;

wherein the toilet seat comprises:

a seat outer peripheral extent and a seat inner peripheral extent defining an aperture; and a space extending between the seat outer peripheral extent and the seat inner peripheral extent forming spaced-apart ends of the seat, wherein the fourth barrier member is coupled to the seat inner peripheral extent;

wherein when the third barrier member and the fourth barrier member sealingly engage with each other, the movement of material from inside the toilet bowl onto a top surface of the toilet seat is inhibited or reduced.

5. A device configured for sealing a toilet, the toilet comprising a toilet bowl, a toilet seat and a toilet lid, the device comprising:

at least one first barrier comprising at least one first barrier member and at least one second barrier member configured to releasably sealingly engage with and magnetically attract to each other;

at least one second barrier comprising at least one third barrier member and at least one fourth barrier member configured to releasably sealingly engage with and magnetically attract to each other;

wherein the at least one first barrier member is configured to be coupled to the toilet lid;

wherein the at least one second barrier member is configured to be coupled to the toilet seat;

wherein the at least one third barrier member is configured to be coupled to the toilet seat;

wherein the at least one fourth barrier member is configured to be coupled to the toilet bowl;

wherein when the at least one first barrier member and the at least one second barrier member sealingly engage with each other and the at least one third barrier member and the at least one fourth barrier member sealingly engage with each other, the at least one first barrier and the at least one second barrier inhibit or reduce movement of material from inside the toilet bowl to outside the toilet bowl.

6. The device of claim 5, wherein the first barrier member is coupled to a lid outer peripheral extent of the lid;

wherein the toilet seat comprises:

a seat outer peripheral extent and a seat inner peripheral extent defining an aperture;

wherein the second barrier member is coupled to the seat inner peripheral extent;

wherein when the first barrier member and the second barrier member sealingly engage with each other, the movement of material from inside the toilet bowl onto a top surface of the toilet seat is inhibited or reduced.

* * * * *